United States Patent [19]

Rosink

[11] Patent Number: 4,495,677

[45] Date of Patent: Jan. 29, 1985

[54] METHOD AND APPARATUS FOR COILING FIBER SLIVER

[75] Inventor: Albert Rosink, Nordhorn, Fed. Rep. of Germany

[73] Assignee: Trützschler GmbH & Co. KG, Mönchengladbach, Fed. Rep. of Germany

[21] Appl. No.: 480,116

[22] Filed: Mar. 29, 1983

[30] Foreign Application Priority Data

Apr. 10, 1982 [DE] Fed. Rep. of Germany ..... 3213397

[51] Int. Cl.[3] ..... B65H 54/80

[52] U.S. Cl. ..... 19/159 R

[58] Field of Search ..... 19/159 R, 159 A

[56] References Cited

U.S. PATENT DOCUMENTS 3,069,729 12/1962 Ito ..... 19/159 R
4,432,118 2/1984 Rosink ..... 19/159 R

FOREIGN PATENT DOCUMENTS 2721422 11/1978 Fed. Rep. of Germany .... 19/159 R
3014517 10/1981 Fed. Rep. of Germany .... 19/159 R
2084199 4/1982 United Kingdom ..... 19/159 R

*Primary Examiner*—Louis K. Rimrodt
*Attorney, Agent, or Firm*—Spencer & Frank

[57] ABSTRACT

A method of depositing sliver in a can by a sliver coiler having a rotating coiler head provided with an outlet opening travelling in a circular path, comprises the following steps: discharging sliver from the outlet opening during rotation of the coiler head; introducing sliver from the outlet opening immediately into a stationary annular chamber which can hold at least two superposed sliver coils and which is aligned with the circular path and which further has an open top oriented towards the outlet opening and an open bottom oriented away from the outlet opening; compressing the sliver in the annular chamber upon introduction therein and ejecting a lowermost sliver coil from the annular chamber through the bottom thereof by the pressure of a superposed compressed sliver coil dwelling in the annular chamber.

10 Claims, 7 Drawing Figures

METHOD AND APPARATUS FOR COILING FIBER SLIVER

BACKGROUND OF THE INVENTION

This invention relates to a method and apparatus for depositing (coiling) a fiber sliver into a coiler can associated, for example, with a carding machine or drawing frame. The apparatus (coiler) has a rotary coiler head supported in a stationary head plate. During normal operation of the coilar, guide rollers (calender rollers) draw the sliver into the coiler head which, in turn, deposits the sliver into a coiler can situated therebelow.

According to a known coiling method the sliver is deposited from the coiler head directly into the underlying coiler can. During this operation, the underside of the coiler head is in frictional engagement with the upper side of the deposited sliver coils; this may adversely affect the uniformity (Uster value) of the sliver. Also, the increased pressure on the deposited sliver may cause a deterioration of the uniformity thereof. Further, with the known method the extent to which the coiler can is filled is limited because the sliver, subsequent to the compression by the guide rollers, during which air escapes from the sliver, again expands during its travel from the coiler head into the can.

SUMMARY OF THE INVENTION

It is an object of the invention to provide an improved method and apparatus of the above-outlined type from which the mentioned disadvantages are eliminated so that an adverse effect on the sliver uniformity is avoided and an increased extent of fill of the coiler can is achieved.

These objects and others to become apparent as the specification progresses, are accomplished by the invention, according to which, briefly stated, a first sliver coil is pressed from above into a circular slot (annular chamber) whereby the first sliver coil is compressed and subsequently, at least one further sliver coil is pressed from above into the annular chamber onto the first sliver coil, whereby the first sliver coil is pushed out downwardly from the annular chamber into the coiler can, while components defining the lateral boundaries of the annular chamber remain stationary.

By providing an annular chamber and stationary elements (closure plate and pressing plate) between the rotary coiler head and the sliver coils deposited into the coiler can, a direct rotary frictional engagement between a lower slide face of the coiler head and the sliver deposited into the coiler can is prevented, resulting in a more gentle handling of the sliver. According to the invention, frictional contact between the lower slide face of the coiler head and the sliver occurs only in the annular chamber and expediently, only with a single sliver coil. By pressing the sliver into the annular chamber, the air escapes from the sliver so that the slide face of the coiler head frictionally engages a compressed sliver coil which has a greater extent of cohesion, whereby an adverse effect on the sliver uniformity is avoided. It is a further advantage of the invention that the compressed sliver enters from the annular chamber directly into the coiler can and is deposited on the already previously deposited slivers whereby a larger quantity of sliver may be accommodated in the coiler can. In this manner, the invention provides for an optimal gentle handling of the sliver and an optimal sliver compression during the deposition of sliver in coils.

The apparatus (coiler) according to the invention has a coiler head having an axis of rotation and including an inlet opening through which sliver enters into the coiler head and an outlet opening through which sliver leaves the coiler head. The outlet opening is provided eccentrically with respect to the rotary axis, whereby the outlet opening travels in a circular path upon rotation of the coiler head. The coiler further has an annular chamber immediately adjoining the outlet opening and being in alignment with the circular path. The annular chamber has an open top oriented towards the outlet opening in the coiler head for receiving sliver from the outlet opening and an open bottom, through which the sliver leaves the annular chamber and is received in a can positioned underneath the coiler.

DESCRIPTION OF THE PREFERRED EMBODIMENT

Figure 1:
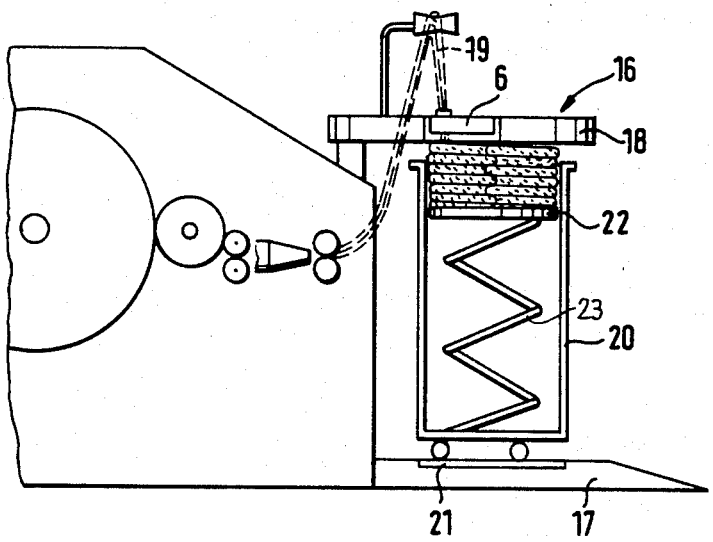
FIG. 1 is a schematic side elevational view of a sliver coiler incorporating the invention.

Turning now to FIG. 1, there is shown schematically a sliver coiler generally indicated at 16 which has an elongated base plate 17 and a head plate 18. The two horizontally extending plates 17 and 18 are positioned vertically spaced with respect to one another.

Figure 2:
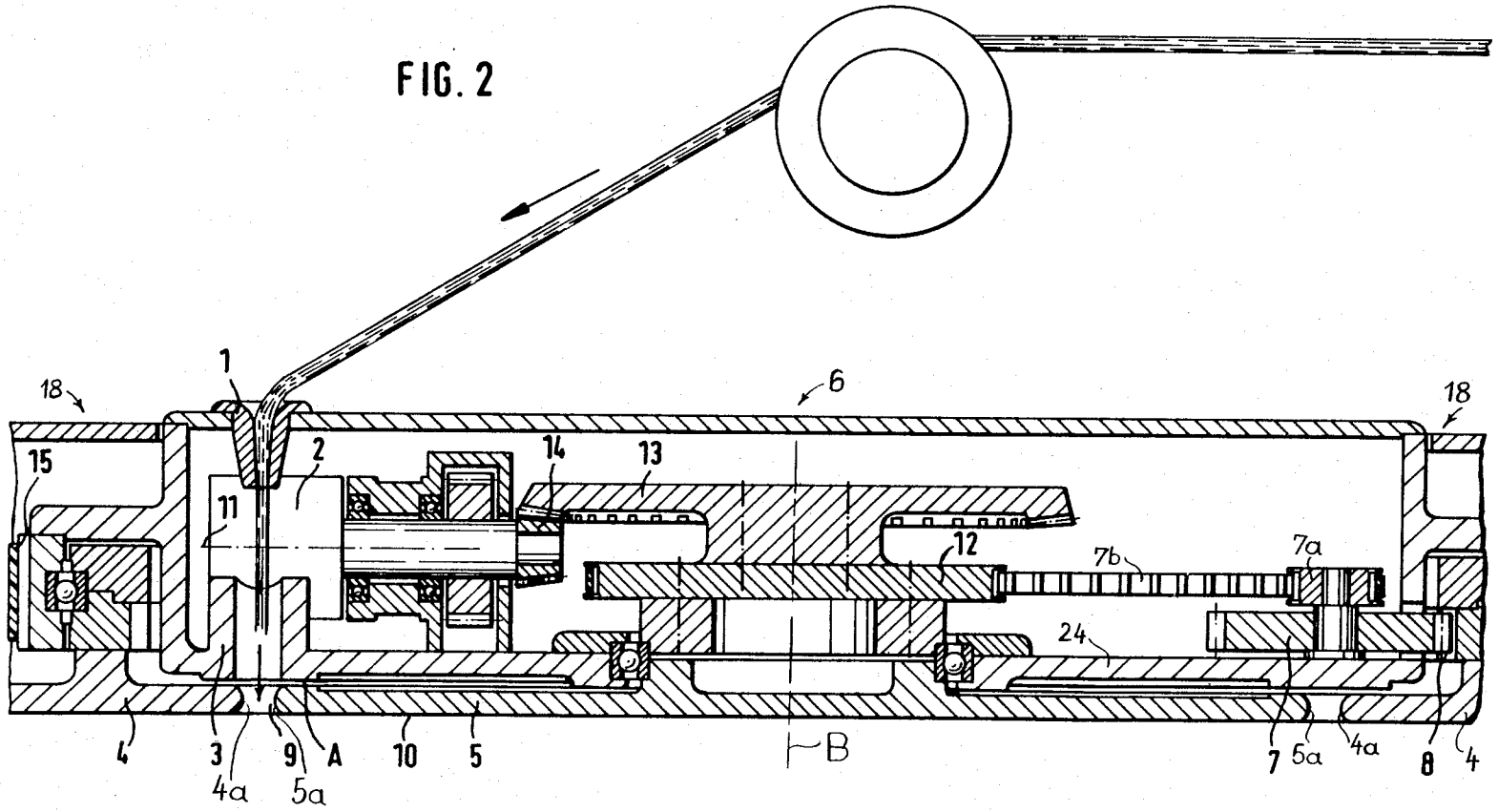
FIG. 2 is a sectional side elevational view, on an enlarged scale with respect to FIG. 1, of a preferred embodiment of the invention.

Also turning now to FIG. 2, the head plate 18 supports a rotary coiler head 6 which includes a trumpet (nozzle) 1 and feed rollers (calender rollers) 2. The head plate (head plate assembly) 18 has a lower closure plate 4 which has a circular edge 4*a* defining a circular opening concentric with the rotary coiler head 6. In the circular opening there is disposed a circular pressing plate 5 which is relatively rotatably mounted on the coiler head 6 and which has a circular periphery 5*a*. The underside of the pressing plate 5 is situated substantially coplanar with the underside of the lower closure plate 4 of the head plate 18. During normal operation of the coiler 16 the calender rollers 2 are driven such that the sliver 19 which is supplied to the coiler head 6 by means of the trumpet 1 is deposited in a can 20 supported on the base plate 17 of the coiler 16 underneath the coiler head 6 and the head plate 18.

The base plate 17 includes a rotary bottom plate 21 to impart a rotary motion on the can 20, resting on the bottom plate 21, when sliver 19 is being deposited into the can 20 by means of the coiler head 6. The can 20 has a planar underside which may be provided either with a stationary fixed bottom or with a vertically movable platform bottom 22 urged upwardly by a compression spring 23. In case the coiler can 20 has a vertically movable, upwardly urged platform bottom 22, the sliver 19 introduced into the can 20 projects upwardly beyond the upper edge of the coiler can 20 and engages the substantially planar underside of the lower closure plate 4 of the head plate 18 and the pressing plate 5 during most of the coiling operation as well as subsequent to the filling of the coiler can 20. If, on the other hand, the coiler can 20 is of the type which has a stationary bottom, the sliver 19 contained in the can 20 projects beyond the upper coiler can edge and engages under pressure the lower face of the head plate assembly 18 and the pressing plate 5 only after the coiler can 20 is filled. Thus, in either case, after filling the coiler can 20, the deposited sliver projects beyond the upper edge of the coiler can as indicated in FIG. 1. The deposited sliver, by virtue of its inherent elasticity and/or by virtue of the biasing force of the spring 23 urging upwardly the movable bottom 22, is pressed against the lower faces of the head plate assembly 18 and the pressing plate 5. In case no pressing force is exerted from above onto the sliver 19 accommodated in the coiler can 20, the sliver 19 projects to a greater extent beyond the upper edge of the coiler can 20. Such is the case, for example, during transport of the coiler can 20 when, during can replacement, the filled coiler can 20 Is moved off (for example, rolled away) the base plate 17 from its position underneath the coiler head 6.

Still referring to FIG. 2, the coiler head 6 is rotated about a rotary axis B by a toothed belt 15 meshing with the toothed periphery of the coiler head 6. As the latter rotates, the calender rollers 2 orbit therewith and rotate, by virtue of a travelling pinion meshing with a bevel gear 13 which remains stationary, as will be described below. As a result, the coiler head 6 pulls, by virtue of the rotating calender rollers 2, the sliver through the trumpet 1 and introduces it into a guide tube 3 provided in the outer zone of an annular bottom plate 24 of the coiler head 6. The tube 3 has an outlet opening which travels circularly and with which there is continuously aligned a slot-like, downwardly narrowing annular chamber 9 laterally defined by the circular edge 4*a* of the lower closure plate 4 and the circular periphery 5*a* of the pressing plate 5. From the guide tube 3 sliver is introduced into the annular chamber 9 and therefrom, in a manner described in more detail below, into the coiler can 20.

As the coiler can is being filled, thus, as the sliver coils spiral up to the pressing plate 5, a pressure builds up between the pressing plate 5 and the deposited sliver by virtue of the accumulation of material.

Figure 2A:
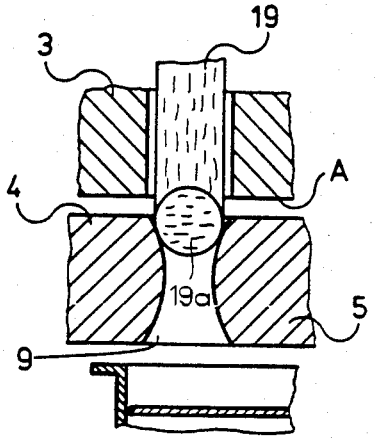
FIGS. 2*a*, 2*b*, 2*c* and 2*d* are sectional side elevational views, on an enlarged scale with respect to FIG. 2, of some of the components of FIG. 2, showing the position of the sliver in successive operational phases.
Figure 2B:
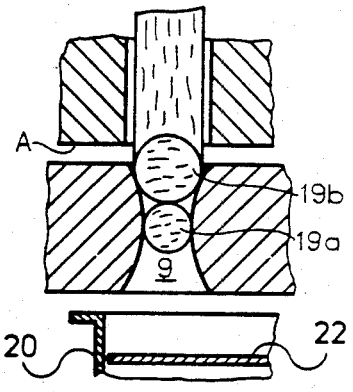
Figure 2C:
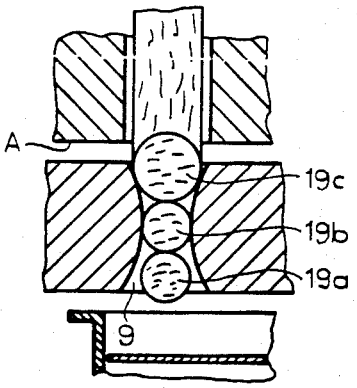
Figure 2D:
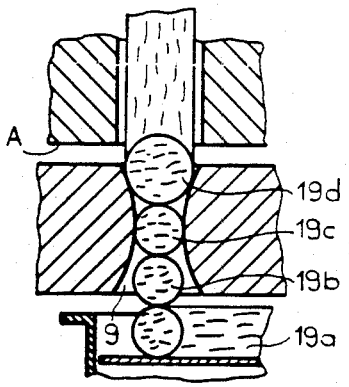

Turning now to FIGS. 2*a*, 2*b*, 2*c* and 2*d*, the annular chamber 9 provided according to the invention, ensures that, as the pressure increases, the uniformity of the sliver (Uster value) does not deteriorate. As shown in FIGS. 2*a*, 2*b*, 2*c*, the annular chamber 9, as the pressure increases, is filled with at least two sliver coils (in the illustration of FIG. 2*c* three coils 19*a*, 19*b* and 19*c* are shown) which at that point remain in a compressed state in the chamber 9. Thus, in normal operation rotating coiler head 6 presses, with its lower annular slide face A, the incoming sliver into the annular chamber 9 in which there is already accommodated at least one sliver coil. The slide face A bounds the annular chamber 9 at the open top thereof. As seen in FIGS. 2*c* and 2*d*, by means of the increasing pressure by the slide face A on the momentarily lowest sliver coil 19*a* in the chamber 9 (because of the material accummulation therein represented by coils 19*b*, 19*c* and 19*d*), the lowermost sliver coil 19*a* is pushed out from the annular chamber 9 into the coiler can 20.

The friction between the slide face A and the sliver situated in the annular chamber 9 occurs at all times only with a single sliver coil which lies on the top of the other sliver coil(s) within the annular chamber 9 and which is still in a substantially compressed condition. It is noted that in conventional coiler structures such a frictional engagement occurs between the slide face of the rotary head and a plurality of deposited coils which are already in their expanded (fluffed-up) state.

By virtue of a very small distance (for example, 50 mm) between the location of sliver engagement by the calender rollers 12 (location 11) and the lower face 10 of the pressing plate 5 and by virtue of the compression of the sliver in the annular chamber 9, the passage area of the trumpet 1 may be increased by 30%. The reduced friction in the trumpet 1 advantageously decreases the static charge on the sliver.

The advantages of the invention reside, among others, in that more sliver can be deposited into the can and further, to a great measure, a gentle handling of the sliver is ensured, a static charging of the fibers is decreased and, because of more favorable torques, stresses on the apparatus are reduced.

During operation, while the coiler head 6 is rotating, the pressing plate 5 remains stationary. This is achieved in the following manner: as the coiler head 6, supported by roller bearings, is driven by the belt 15, a spur gear 7 supported in the coiler head 6 rolls on a stationary inner gear 8. The spur gear 7, in turn, rotates a pinion 7*a* which meshes with a toothed belt 7*b* also trained about a gear 12 coaxial with the pressing plate 5. The transmission ratio between gears 7 and 8 and between gears 7*a* and 12 is the same, so that upon one forward revolution of the coiler head 6 the pressing plate 5 executes one reverse revolution so that the pressing plate 5, the gear 12 mounted thereon as well as the bevel gear 13 remain stationary. Thus, during operation no relative motion occurs between the lower closure plate 4 of the head plate 18 and the pressing plate 5.

Figure 3:
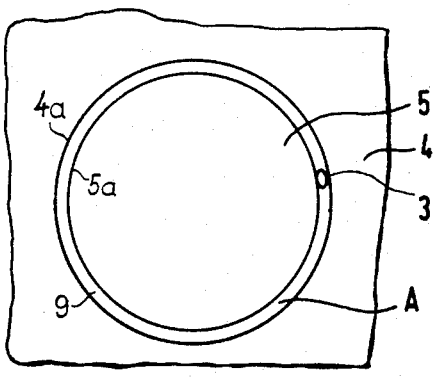
FIG. 3 is a bottom plan view of the structure shown in FIG. 2 at a reduced scale with respect to FIG. 2.

Turning now to FIG. 3 which is a bottom plan view of the structure shown in FIG. 2, there is visible the annular chamber 9 defined laterally by the stationary closure plate 4 and the stationary pressing plate 5 and which is bounded at the top by the rotary slide face A of the rotary head 6. In FIG. 3, through the chamber 9, there is visible the oval opening of the guide tube 3 and a part of the slide face A of the rotary head 6. Thus, the annular chamber 9 is completely covered from above by the rotating slide face A, with the exception of the bore of the guide tube 3. The outlet end (edge) of the bore of the guide tube 3 is expediently rounded in order to prevent damage to the sliver which is deflected at a sharp angle (for example, 90°) as it is pressed into the chamber 9.

It will be understood that the above description of the present invention is susceptible to various modifications, changes and adaptations, and the same are intended to be comprehended within the meaning and range of equivalents of the appended claims.

What is claimed is:

1. A method of depositing sliver in a can by a sliver coiler having a rotating coiler head provided with an outlet opening travelling in a circular path, comprising the following steps:

(a) discharging sliver from said outlet opening during rotation of said coiler head;

(b) introducing sliver from said outlet opening immediately into a stationary annular chamber aligned with said circular path and having an open top oriented towards the outlet opening and an open bottom oriented away from the outlet opening;

(c) compressing said sliver in said annular chamber upon introduction of said sliver in said annular chamber;

(d) causing said annular chamber to hold at least two superposed sliver coils while performing steps (b) and (c); and (e) ejecting a lowermost sliver coil from the annular chamber through the bottom thereof by the pressure of a superposed compressed sliver coil dwelling in said annular chamber.

2. A method as defined in claim 1, wherein the compressing step comprises the step of pressing the sliver into said annular chamber by an annular face forming part of an underside of said coiler head and overlying and bounding the open top of said annular chamber.

3. A coiler for depositing sliver in a can, comprising (a) a coiler head having an axis of rotation and including (1) an inlet opening through which sliver enters into the coiler head;

(2) an outlet opening through which sliver leaves the coiler head; said outlet opening being provided eccentrically with respect to said rotary axis, whereby said outlet opening travels in a circular path upon rotation of said coiler head;

(3) sliver advancing means drawing sliver through said inlet opening and delivering sliver through said outlet opening;

(b) support means for supporting said coiler head for rotation about said axis;

(c) driving means for rotating said coiler head; and (d) stationary means defining an annular chamber immediately adjoining said outlet opening and being in alignment with said circular path; said annular chamber having an open top oriented towards said outlet opening and an open bottom oriented away from said outlet opening; said sliver being received in said annular chamber through said open top and being discharged from said annular chamber through said open bottom.

4. A coiler as defined in claim 3, wherein said coiler head has an underside including an annular slide face bounding said annular chamber at the open top thereof.

5. A coiler as defined in claim 3, wherein said annular chamber is in alignment with said sliver advancing means in a direction parallel to said axis of rotation.

6. A coiler as defined in claim 3, wherein said annular chamber narrows from said open top in a direction away from said coiler head.

7. A coiler as defined in claim 3, further comprising a sliver guide tube having opposite open ends; one of the open ends constituting said outlet opening; said sliver guide tube forming part of said coiler head and being situated between said sliver advancing means and said annular chamber.

8. A coiler as defined in claim 3, wherein said outlet opening is defined by a rounded edge.

9. A coiler as defined in claim 3, wherein said support means comprises a stationary head plate assembly including a bottom closure plate having a circular edge defining a circular opening in said bottom closure plate; further comprising a stationary circular pressing plate disposed in said circular opening of said bottom closure plate and having a peripheral edge; said bottom closure plate and said pressing plate having undersides substantially coplanar with one another; said circular edge of said bottom closure plate and said peripheral edge of said pressing plate constituting said stationary means defining said annular chamber.

10. A coiler as defined in claim 9, wherein said pressing plate is rotatably supported on said coiler head; further comprising means for rotating said pressing plate in a direction opposite to the direction of rotation of said coiler head for maintaining said pressing plate stationary with respect to said bottom closure plate of said head plate assembly.

* * * * *